US007828509B2

(12) United States Patent
Morris et al.

(10) Patent No.: US 7,828,509 B2
(45) Date of Patent: Nov. 9, 2010

(54) FUEL PUMP FOR ENGINE

(75) Inventors: James Paul Morris, Montoursville, PA (US); Forrest Ross Lysinger, Harrisburg, PA (US); Scott Matas, Williamsport, PA (US); William Gundrum, Williamsport, PA (US)

(73) Assignee: Lycoming Engines, a division of Avco Corp., Williamsport, PA (US)

( * ) Notice: Subject to any disclaimer, the term of this patent is extended or adjusted under 35 U.S.C. 154(b) by 866 days.

(21) Appl. No.: 11/708,414

(22) Filed: Feb. 20, 2007

(65) Prior Publication Data

US 2008/0199302 A1 Aug. 21, 2008

(51) Int. Cl.
*F04D 29/10* (2006.01)

(52) U.S. Cl. ..... 415/58.4; 415/168.2; 415/145; 415/229; 415/230

(58) Field of Classification Search ..... 415/230, 415/231, 229, 168.2, 168.1, 58.4, 145; 277/549
See application file for complete search history.

(56) References Cited

U.S. PATENT DOCUMENTS

| | | | | |
|---|---|---|---|---|
| 2,818,283 | A | 12/1957 | Hutterer | |
| 3,100,105 | A * | 8/1963 | Randall | 366/293 |
| 3,934,311 | A * | 1/1976 | Thompson | 452/13 |
| 4,021,155 | A | 5/1977 | Erikson et al. | |
| 4,130,488 | A * | 12/1978 | Speck et al. | 210/232 |
| 4,553,914 | A | 11/1985 | Noell et al. | 418/69 |
| 4,669,735 | A | 6/1987 | Sundberg et al. | 277/1 |
| 5,199,718 | A * | 4/1993 | Niemiec | 277/552 |
| 5,415,134 | A * | 5/1995 | Stewart, Jr. | 123/41.01 |
| 5,740,782 | A | 4/1998 | Lowi, Jr. | 123/446 |
| 5,983,863 | A | 11/1999 | Cavanagh et al. | 123/447 |
| 6,318,973 | B1 | 11/2001 | Sailer et al. | 417/310 |
| 6,783,322 | B2 * | 8/2004 | Ray et al. | 415/112 |

FOREIGN PATENT DOCUMENTS

| | | | |
|---|---|---|---|
| CH | 247517 | A | 3/1947 |
| DE | 4338349 | A1 | 5/1995 |
| WO | 9742415 | A1 | 11/1997 |
| WO | 0003813 | A2 | 1/2000 |

OTHER PUBLICATIONS

International Search Report for PCT Application No. PCT/US2007/082655, issued Mar. 4, 2008 (4 pages).

* cited by examiner

*Primary Examiner*—Ninh H Nguyen
(74) *Attorney, Agent, or Firm*—BainwoodHuang

(57) ABSTRACT

A fuel pump includes a bearing element disposed in proximity to an impeller. The bearing element is configured to form a fuel seal with the impeller and to drain fuel leaked from the pump chamber back into the pump chamber. The bearing element minimizes leakage of fuel from the pump chamber into an engine coupled to the impeller. The fuel pump also includes redundant lip seals configured to provide redundant sealing relative to a shaft of the impeller within the fuel pump in order to minimize engine oil from entering the pump chamber and to minimize fuel from entering the engine. Integration of both the bearing element and the redundant lip seals as part of the fuel pump results in the fuel pump having a relatively compact size.

23 Claims, 5 Drawing Sheets

FUEL PUMP FOR ENGINE

BACKGROUND

Conventional fuel pumps, such as those used with aircraft engines, are typically configured as positive displacement pumps. Typical positive displacement pumps include a housing defining a fuel pump chamber, an impeller rotatably mounted within the fuel pump chamber, and a drive coupling that attaches the impeller to an associated gear box located inside the engine. During operation, as the engine causes the impeller to rotate, the impeller draws fuel from a fuel tank into an inlet port of the housing and causes the fuel to exit into the engine through a discharge port of the housing.

Conventional fuel pumps can utilize several different types of sealing mechanisms to minimize leakage of fluids between the engine and the fuel pump chamber. For example, certain fuel pumps include a bearing that is operable to limit leakage of oil from the drive side of the fuel pump into the fuel pump chamber. The oil-lubricated bearing is disposed about a shaft of the impeller and within the fuel pump housing between the engine and the fuel pump. An inner surface of the bearing contacts the shaft of the impeller. Such contact helps to limit leakage of oil from the engine and the bearing into the fuel pump chamber of the fuel pump.

Other conventional fuel pumps include sealing elements that are operable to limit leakage of fuel from the fuel pump chamber into the engine. For example, certain fuel pumps include concentrically arranged primary and secondary sealing members, disposed between the fuel pump chamber and the engine, configured to form redundant seals with a flat seal face of the impeller (i.e., where the flat seal face of the impeller is substantially perpendicular to the shaft of the impeller). With such a configuration, during operation the primary seal minimizes leakage of fuel from the fuel pump chamber past the impeller and into the engine. In the event that the primary seal fails, the secondary seal becomes pressure loaded against the flat seal face of the impeller face to minimize leakage of fuel from the fuel pump chamber into the engine.

SUMMARY

Conventional fuel pumps suffer from a variety of deficiencies. For example, while a bearing can be used as a seal to minimize leakage of oil from an engine into a fuel chamber, even with the relatively tight tolerance between the bearing and the impeller shaft, oil from the engine can leak past the bearing into the fuel chamber and potentially damage the fuel pump. Also, while the use of concentrically arranged primary and secondary sealing members can minimize leakage of fuel from a fuel pump chamber past the impeller and into an engine, the use of such a sealing mechanism is fairly expensive.

In contrast to the conventional fuel pumps, embodiments of the invention are directed to a fuel pump that utilizes a variety of sealing elements to limit the flow of engine oil into a fuel pump chamber and to minimize fuel from entering an associated engine. The fuel pump includes a bearing element disposed in proximity to an impeller. The bearing element is configured to form a fuel seal with the impeller and to drain fuel leaked from the pump chamber back into the pump chamber. The fuel pump also includes redundant lip seals configured to provide redundant sealing relative to a shaft of the impeller within the fuel pump in order to minimize engine oil from entering the pump chamber and to minimize fuel from entering the engine. Integration of both the bearing element and the redundant lip seals as part of the fuel pump results in the fuel pump having a relatively compact size. Additionally, the use of the bearing element and the redundant lip seals to minimize fluid leakage within the fuel pump reduces the costs related to assembly of the fuel pump, compared to conventional fuel pumps.

In one arrangement, a fuel pump includes a housing and an impeller disposed within the housing. The impeller and the housing defines a pump chamber having a pump inlet and a pump outlet and a housing chamber, the impeller being operable to rotate within the housing to transfer fuel from the pump inlet, through the pump chamber to the pump outlet. The fuel pump includes a bearing element disposed within the housing chamber about a shaft of the impeller, the bearing element having a sealing face opposing the impeller and being operable to form a fuel seal with the impeller. The fuel pump includes a first lip seal disposed within the housing chamber about the shaft of the impeller and a second lip seal disposed within the housing chamber about the shaft of the impeller where the first lip seal disposed between the bearing element and the second lip seal. The first lip seal is operable to form a fuel seal with the shaft of the impeller while the second lip seal is operable to form an oil seal with the shaft of the impeller. Integration of both the bearing element and the redundant lip seals as part of the fuel pump results in the fuel pump having a relatively compact size and a lower associated production cost relative to conventional fuel pumps.

In one arrangement, an engine assembly includes an engine and a fuel pump coupled to the engine. The fuel pump includes a housing and an impeller disposed within the housing. The impeller and the housing define a pump chamber having a pump inlet and a pump outlet and define a housing chamber. The impeller is operable to rotate within the housing to transfer fuel from the pump inlet, through the pump chamber, to the engine via the pump outlet. The fuel pump includes a bearing element disposed within the housing chamber about a shaft of the impeller, the bearing element having a sealing face opposing the impeller and being operable to form a fuel seal with the impeller. The fuel pump includes a first lip seal disposed within the housing chamber about the shaft of the impeller and a second lip seal disposed within the housing chamber about the shaft of the impeller, the first lip seal being disposed between the bearing element and the second lip seal. The first lip seal is operable to form a fuel seal with the shaft of the impeller. The second lip seal is operable to form an oil seal with the shaft of the impeller.

One embodiment of the invention relates to a method for assembly of a fuel pump. The method includes disposing an impeller within the housing, the impeller and the housing defining a pump chamber having a pump inlet and a pump outlet and defining a housing chamber, the impeller being operable to rotate within the housing to transfer fuel from the pump inlet, through the pump chamber to the pump outlet. The method includes disposing a bearing element within the housing chamber about a shaft of the impeller, the bearing element having a sealing face opposing the impeller and being operable to form a fuel seal with the impeller. The method includes disposing a first lip seal within the housing chamber about the shaft of the impeller and a second lip seal disposed within the housing chamber about the shaft of the impeller, the first lip seal disposed between the bearing element and the second lip seal, the first lip seal being operable to form a fuel seal with the shaft of the impeller and the second lip seal being operable to form an oil seal with the shaft of the impeller.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views. The drawings are not necessarily to scale, emphasis instead being placed upon illustrating the principles of various embodiments of the invention.

DETAILED DESCRIPTION

Embodiments of the invention are directed to a fuel pump that utilizes a variety of sealing elements to limit the flow of engine oil into a fuel pump chamber and to minimize fuel from entering an associated engine. The fuel pump includes a bearing element disposed in proximity to an impeller. The bearing element is configured to form a fuel seal with the impeller and to drain fuel leaked from the pump chamber back into the pump chamber. The fuel pump also includes redundant lip seals configured to provide redundant sealing relative to a shaft of the impeller within the fuel pump in order to minimize engine oil from entering the pump chamber and to minimize fuel from entering the engine. Integration of both the bearing element and the redundant lip seals as part of the fuel pump results in the fuel pump having a relatively compact size. Additionally, the use of the bearing element and the redundant lip seals to minimize fluid leakage within the fuel pump reduces the costs related to assembly of the fuel pump, compared to conventional fuel pumps.

Figure 1:
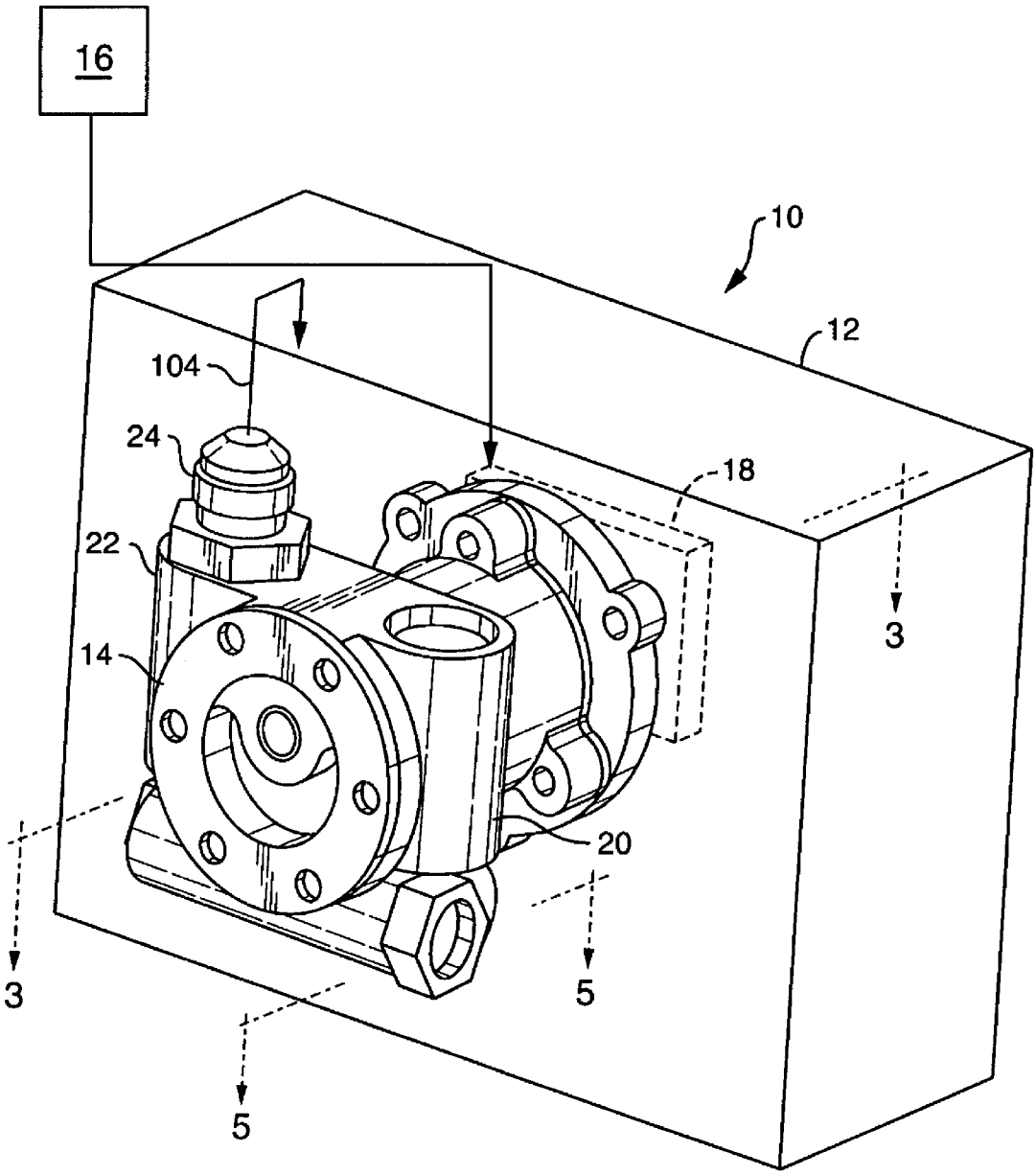
FIG. 1 illustrates an engine assembly having a fuel pump according to one embodiment.
Figure 4:
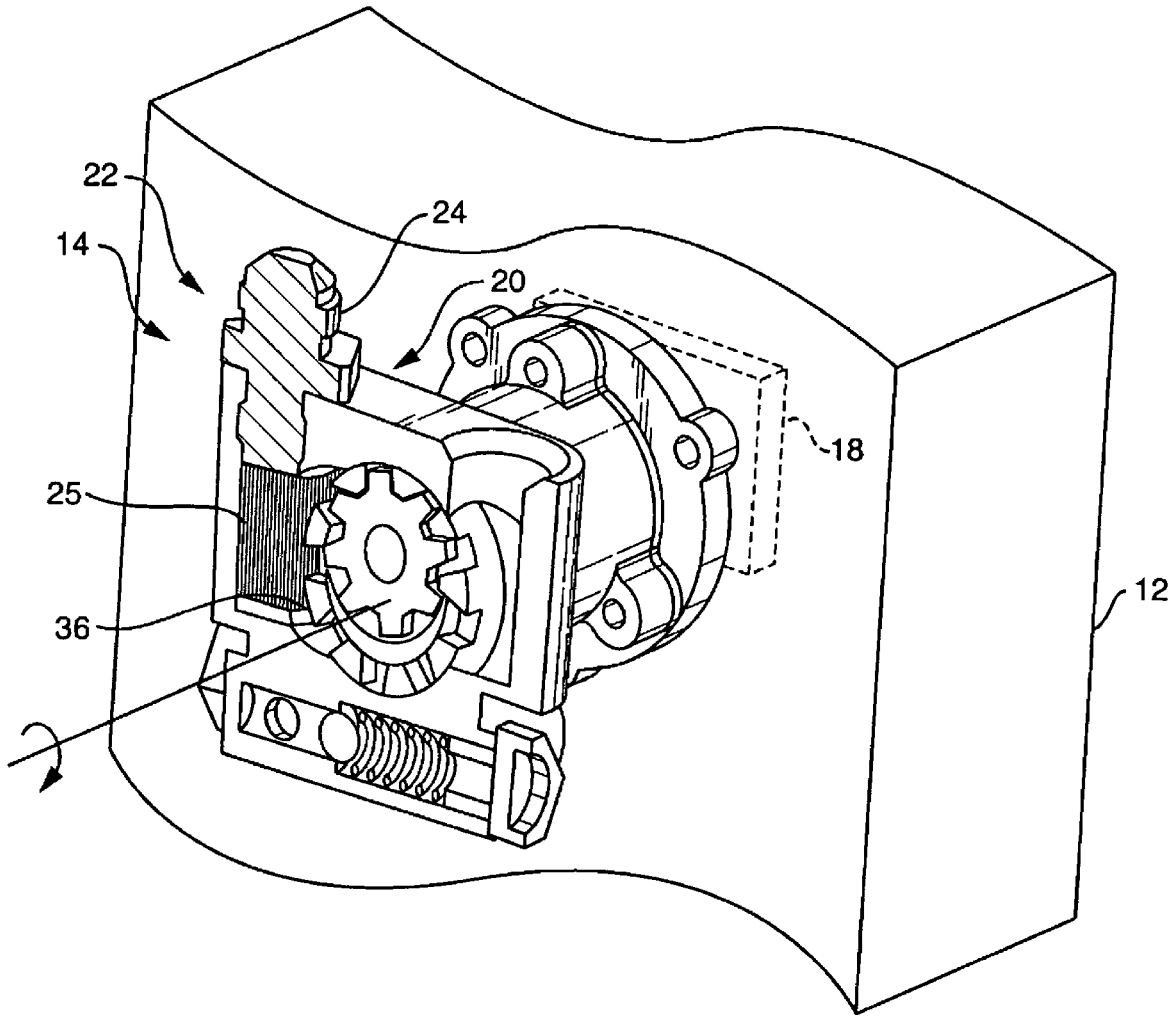
FIG. 4 illustrates a bottom perspective and partial cutaway view of the engine assembly of FIG. 1.

FIGS. 1 and 4 illustrate an embodiment of an engine assembly 10 having an engine 12, such as an aircraft engine, and a fuel pump 14, such as a positive displacement fuel pump. The engine 12 is configured to operate the fuel pump 14 and cause the fuel pump 14 to draw fuel from a fuel tank 16 and deliver the fuel to the engine 12. For example, in one arrangement, the engine 12 includes a driving apparatus 18, such as a gear box, that couples to an impeller 36 of the fuel pump 14. In use, as the driving apparatus 18 rotates the impeller 36 within the fuel pump 14, the impeller 36 decreases the pressure of the fuel at a pump inlet 20 and increases the pressure of the fuel at the pump outlet 22. The pressure differential causes the fuel to flow through the fuel pump 14 and exit the fuel pump 14 through a fuel filter 24 disposed within a pump outlet chamber 25 and into the engine 12.

Figure 2:
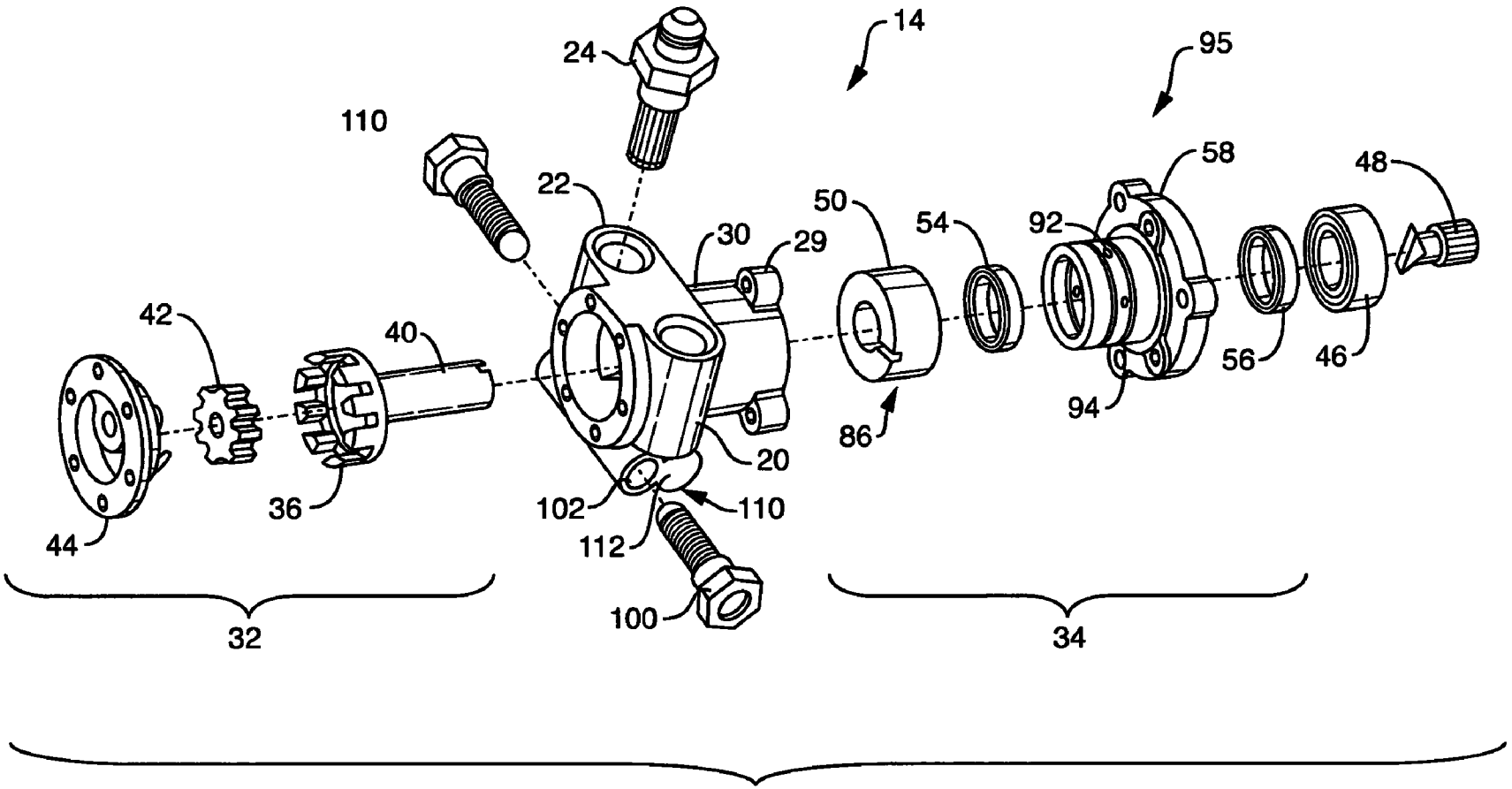
FIG. 2 illustrates an exploded perspective view of the fuel pump of FIG. 1.
Figure 3:
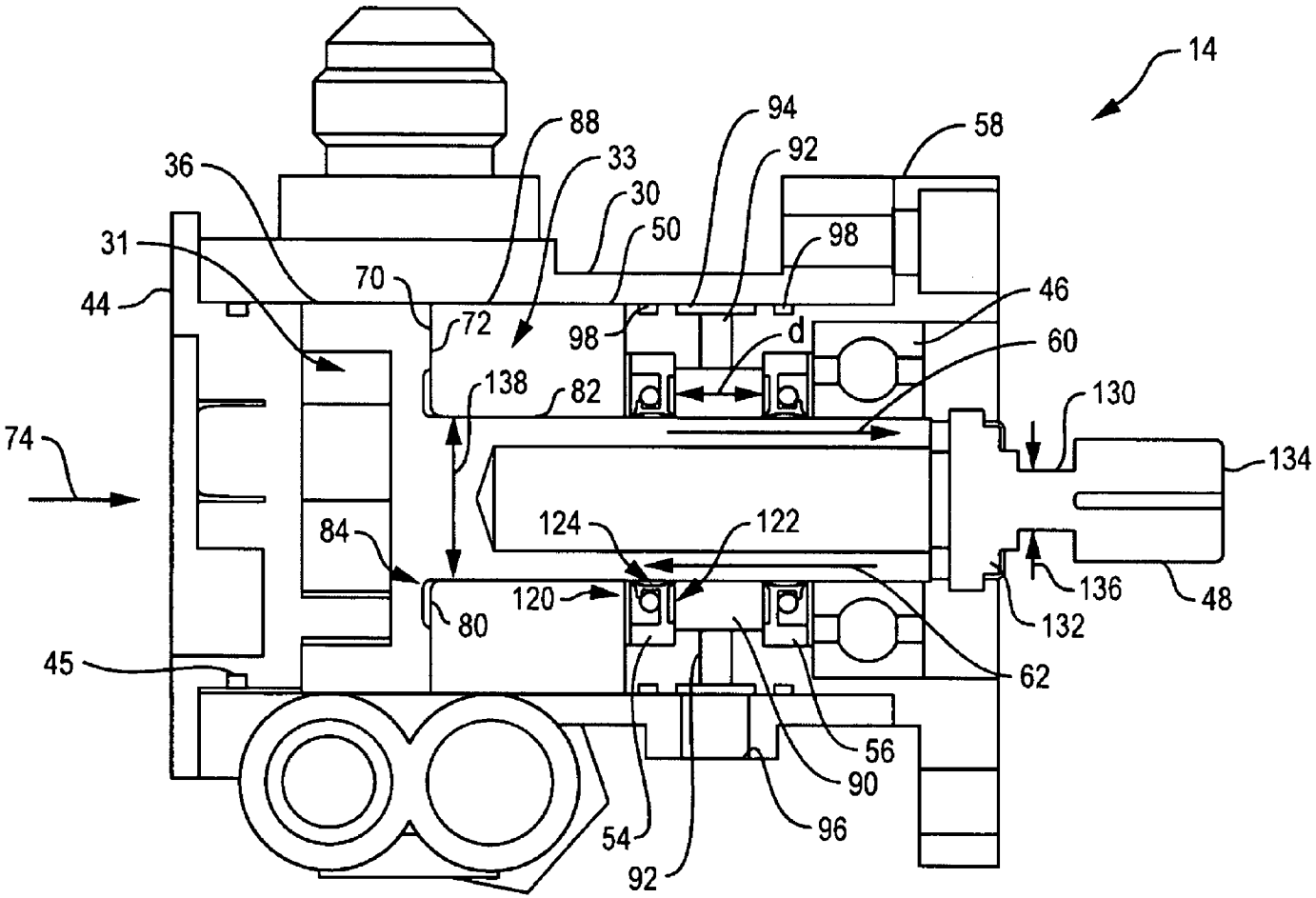
FIG. 3 illustrates a side sectional view of the fuel pump of FIG. 1.

FIGS. 2 and 3 illustrate details of the embodiment of the fuel pump 14 shown in FIGS. 1 and 4. The fuel pump 14 includes a housing 30 that contains an impeller assembly 32 and a sealing assembly 34.

The housing 30 couples to the engine 12 by way of fasteners disposed through coupling elements 29 formed as part of the housing 30. While the housing 30 can be formed from a number of materials, in one arrangement, the housing 30 is formed from a high-grade aluminum material anodized to a migration depth of between about 0.002 inches and about 0.003 inches.

The impeller assembly 32 includes the impeller 36 having a shaft 40, an idler gear 42 at least partially meshed with the impeller 36, and an impeller cover 44 that secures the impeller 36 to the housing. The impeller 36 and idler gear 42 are configured to rotate within the housing 30 to transfer fuel from the pump inlet 20 to the pump outlet 22. The impeller cover 44 forms a seal with the housing 30 via an O-ring 45 which allows for precise clearance setting of the impeller 36 and idler gear 42 within the housing 30. While the impeller cover 44 can be formed from a number of materials, in one arrangement, the impeller cover 44 is formed from a high-grade aluminum material anodized to a migration depth of between about 0.002 inches and about 0.003 inches. A bearing 46, such as a ball bearing assembly, supports the shaft 40 of the impeller 36 within the housing 30 and allows rotation of the impeller 36 relative to the housing 30. The bearing 46 receives lubricating oil from the engine 12. A drive coupling element 48 attaches the shaft 40 of the impeller 36 to the driving apparatus 18 of the engine 12. For example, the drive coupling element 48 includes a gear portion that mates with gear elements of the driving apparatus 18.

When disposed within a bore extending through a length of the housing 30, the impeller 36 divides the bore into two chambers. For example, as illustrated in FIG. 3, the impeller 36 and the housing 30 define a pump chamber 31 and a housing chamber 33. The pump chamber 31 is in fluid communication with the pump inlet 20 and the pump outlet 22 of the housing 14 and is configured to contain fuel as the impeller 26 rotates within the housing 30 and transfers the fuel from the pump inlet 20 to the pump outlet 22. The housing chamber 33 is configured to contain the sealing assembly 34 which minimizes leakage of fuel and oil within the fuel pump 14. Details of an arrangement of the sealing assembly 34 are provided below.

In one arrangement, the sealing assembly 34 includes a bearing element 50 as well as a carrier sleeve 58 containing a first lip seal 54 and a second lip seal 56.

The bearing element 50 is configured to minimize leakage of fuel from the pump chamber 31 into the housing chamber 33. While the bearing element can be formed from a number of materials, in one arrangement, the bearing is formed from a high strength bearing material such as carbon, polytetrafluoroethylene (PTFE), or Tetrafluoroethylene (TFE) fluorocarbon based (e.g., RULON™) materials.

In order to minimize leakage of fuel from the pumping chamber 31, the bearing element 50 forms a seal with both the impeller 36 and the impeller shaft 40 within the housing 30. For example, as shown, the bearing element 50 is disposed within the housing chamber 33 about the shaft 40 of the impeller 36 and between the impeller 36 and the carrier sleeve 58. The interaction between the bearing element 50 and both the impeller 36 and the shaft 40 minimizes leakage of fuel from the pump chamber 31 and into the engine 12.

For example, as shown in FIG. 3, the bearing element 50 has a sealing face 70 that opposes a face portion 72 of the impeller 36. Interaction between the sealing face 70 and the face portion 72 acts to form a fuel seal during operation. For example, in use, as the impeller 36 rotates within the housing 30, fuel enters the pump chamber 31 and increases the fluid pressure within the chamber 31. The increase in fluid pressure causes the impeller 36 to translate along direction 74 which, in turn, causes the face portion 72 of the impeller 36 to abut the sealing face 70 of the bearing element 50. Such relative positioning between the sealing face 70 and the face portion 72 minimizes a gap formed between the bearing element 50 and the impeller 36 and, as a result, minimizes leakage of the fuel from the pump chamber 31 past the impeller 26.

Also, as indicated in FIG. 3, the bearing element 50 surrounds a portion of the shaft 40 of the impeller 36. In order to minimize leakage of the fuel from the pump chamber 31 along the shaft 40, the bearing element 50 forms a relatively tight fit with the shaft 40. For example, the clearance between the shaft 40 and an inner circumference of the bearing element 50 is between about 0.0005 inches and 0.001 inches. Such a relatively narrow clearance allows the shaft 40 to rotate relative to the bearing element 50 but limits the ability for fuel to flow between the bearing element 50 and the shaft 40.

While the interaction between the bearing element 50 and the impeller 36 and between the bearing element 50 and the shaft 40 is configured to minimize leakage of the fuel from the pump chamber 31, in one arrangement, the bearing element 50 is configured to direct any fuel leaked from the pump chamber 31 back into the pump chamber 31. For example, as illustrated in FIGS. 2 and 3, the bearing element 50 includes a chamfered edge 80, such as a 45° chamfered edge, formed along an inner periphery 82 of the bearing element 50 and forming a fluid collection volume 84 with the shaft 40 and the impeller 36. The bearing element 50 also includes a channel 86 formed in the sealing face 70 of the bearing element 50. As shown, the channel 86 that extends from the inner periphery 82 of the bearing element 50 to an outer periphery 88 of the bearing element 50. The bearing element 50 is oriented within the housing 30 such that the channel points toward, and is in fluid communication with, the pump inlet 20 of the fuel pump 14.

In use, in the event of a fuel leak from the pump chamber 31, the fuel collects within the fluid collection volume 84 defined between the chamfered edge 80, the impeller 36 and the shaft 40. Furthermore, during operation of the impeller 36, as the impeller 36 draws fuel into the pump chamber 31 from the fuel source 16, the impeller 36 crates a low pressure zone or vacuum within the pump chamber 31 in proximity to the pump inlet 20. This vacuum causes the leaked fuel to flow from the fluid collection volume 84, along the channel 86, through the pump inlet 20, and into the pump chamber 31. Therefore, the configuration of the bearing element 50 in this embodiment allows removal of leaked fuel from the housing 30 before the fuel is able to leak further into the housing chamber 33.

As indicated above, the sealing assembly 34 of the fuel pump 14 includes the carrier sleeve 58 having the first lip seal 54 and the second lip seal 56 disposed, such as by a press fit, therein. The carrier sleeve 58 is disposed within the housing chamber 33 and is operable to hold the first and second lip seals 54, 56 in a substantially concentric relationship, to provide support for the bearing element 50, and to set the clearance of the impeller 36 and idler 42 relative to the impeller cover 44. While the carrier sleeve 58 can be formed from a variety of materials, in one arrangement, the carrier sleeve 58 is formed from a high-grade aluminum material anodized to a migration depth of between about 0.002 inches and about 0.003 inches.

As shown in FIG. 3, the carrier sleeve 58 positions the first and second lip seals 54, 56 about the shaft 40 of the impeller 36. The first and second lip seals 54, 56 provide redundant sealing within the fuel pump 14 to minimize engine oil from entering the pump chamber 31 and to minimize fuel from entering the engine 12.

For example, the first lip seal 54 is configured to form a fuel seal with the shaft 40 of the impeller 36. In the event that fuel were to leak past the bearing element 50, the seal formed between the first lip seal 54 and the shaft 40 minimizes leakage of the fuel along a first direction 60 relative to the shaft 40 and into the engine 12. Additionally, the first lip seal 54 acts as a redundant back-up to the second lip seal 56. For example, in the event that the second lip seal 56 were to fail, oil from the engine 12 (e.g., as used to lubricate the bearing 46) would leak along a second direction 62 relative to the shaft 40 and toward the pump chamber 31. As a back-up seal, the first lip seal 54 operates to both limit leakage of the oil along the second direction 62 and into the pump chamber 31 and minimize leakage of the fuel along the first direction 60 and into the engine 12.

The second lip seal 56 is configured to form a form an oil seal with the shaft 40 of the impeller 36. In the event that oil were to leak from the bearing 46, the seal formed between the second lip seal 56 and the shaft 40 minimizes leakage of the oil along the second direction 62 relative to the shaft 40 and into the pump chamber 31. Additionally, the second lip seal 56 acts as a redundant back-up to the first lip seal 54. For example, in the event that the first lip seal 54 were to fail, fuel from the pump chamber 31 would leak toward the engine 12 along the first direction 60 relative to the shaft 40. As a back-up seal, the second lip seal 54 operates to both minimizes leakage of the oil along the second direction and shaft 40 and into the pump chamber 31 and limit leakage of the fuel along the first direction relative to the shaft 40 and into the engine 12.

In one arrangement, the first and second lip seals 54, 56, along with the carrier sleeve 58, are configured to capture both leaked oil and fuel within the fuel pump 14 and to allow drainage of the captured fluids from the fuel pump 14. For example, as illustrated in FIG. 3, the first and second lip seals 54, 56 are disposed within the carrier sleeve 58 at a distance d from each other. In this configuration, the first and second lip seals 54, 56 define a fluid containment volume 90 with the carrier sleeve 58. In the event that fuel were to leak past the first lip seal 54 and oil were to leak past the second lip seal 56, the fluid containment volume 90 collects the leaked fluid within the fuel pump 14.

The carrier sleeve 58 and the housing 30 form a drainage assembly 95 configured to provide drainage of the fuel and oil mixture collected within the fluid containment volume 90. For example, in one arrangement, the carrier sleeve 58 defines drain ports 92 disposed radially about a circumference of the carrier sleeve 58 and positioned between the first lip seal 54 and the second lip seal 56 in fluid communication with the fluid containment volume 90. The carrier sleeve 58 also defines a channel 94 disposed about an outer periphery of the carrier sleeve 58, the channel 94 being in fluid communication with the drain ports 92 and with an outflow port 96 of the housing 30. The carrier sleeve 58 includes sealing rings 98, such as O-rings, to seal fluid contained by the channel 94 from leaking into the housing 30. The combination of the drain ports 92, the channel 94, and the outflow port 96 allows for the removal of the fluids collected within the fluid containment volume 90 from the fuel pump 14.

For example, assume the fuel pump 14 is used as part of an aircraft engine, where the position of the drain ports 92 relative to the ground can change over time. During operation, as the fluid containment volume 90 collects both fuel and oil leaked within the fuel pump 14, the fluid mixture flows from the fluid containment volume 90 through one or more of the drain ports 92, depending upon the orientation of the fuel pump 14 relative to the ground. As the fluid mixture exits the drain ports 92, the channel 94 collects the fluid mixture and directs the fluid mixture toward the outflow port 96 of the housing 30. As the outflow port 96 receives the fluid mixture, the port 96 drains the fluid mixture to a location external to the fluid pump 14, such as to the atmosphere. The combination of the drain ports 92, the channel 94, and the outflow port 96 allows drainage of the fluid mixture from the fuel pump 14 regardless of the position of the aircraft engine during operation.

As indicated, the fuel pump 14 includes, within the fuel pump housing 30, a bearing element 50 configured to form a fuel seal with the impeller 36 and to drain fluid leaked from the pump chamber 31 back into the pump chamber 31 and redundant lip seals 54, 56 configured to provide redundant sealing within the fuel pump 14 to minimize engine oil from entering the pump chamber 31 and to minimize fuel from entering the engine 12. The fuel pump 14 also includes a drainage assembly 95 configured to provide drainage of fuel and oil mixture collected within the fluid containment volume 90. With the fuel pump 14 containing a minimal number of parts to provide such fluid management within the fuel pump, the fuel pump 14 can be easily assembled by a manufacturer at a relatively reduced cost as compared to conventional fuel pumps.

Figure 5:
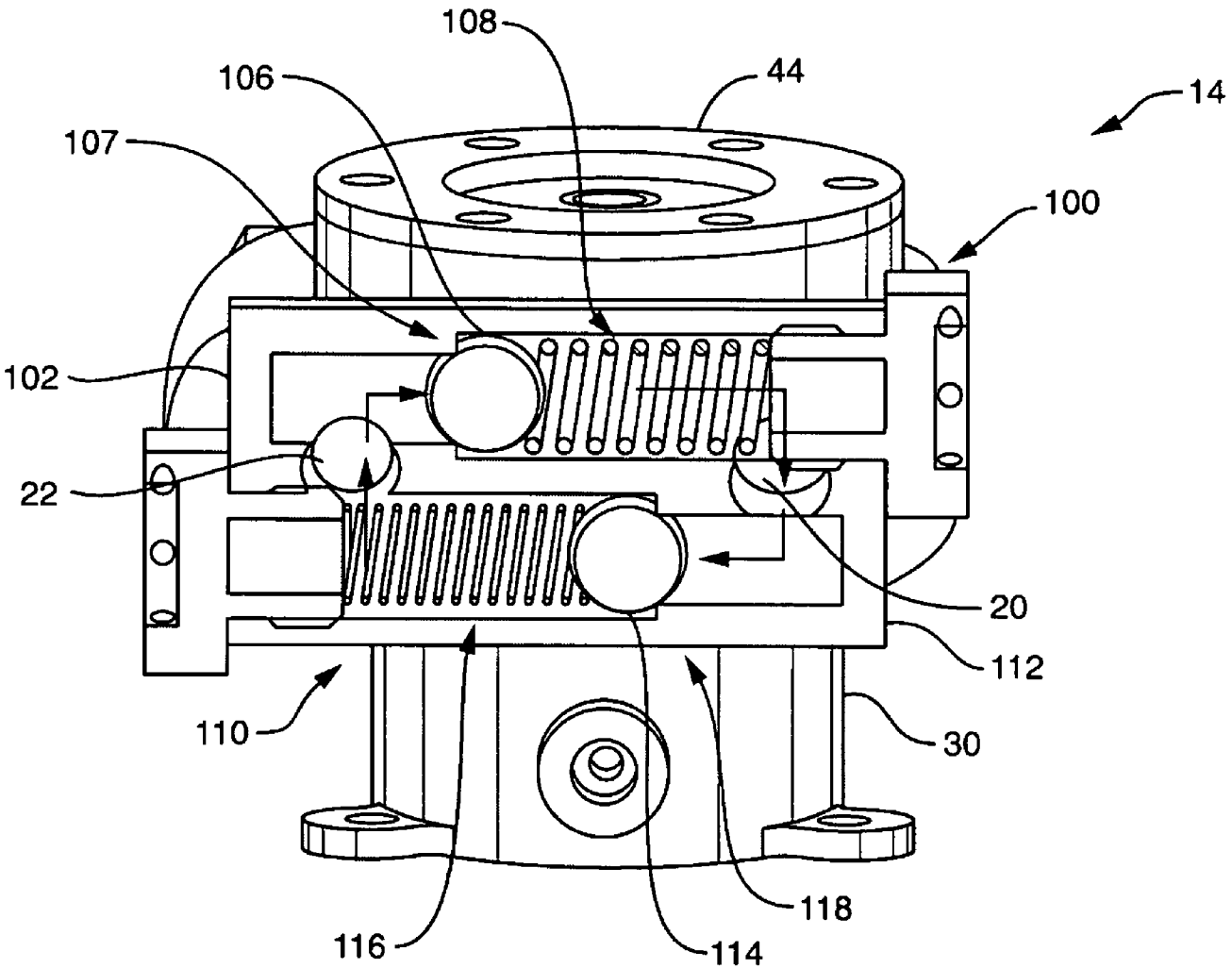
FIG. 5 illustrates a side sectional view of a low pressure bypass assembly and a high pressure bypass assembly of the fuel pump of FIG. 1.

In one arrangement, the fuel pump 14 is configured with safety features in order to allow operation of the engine 12 in the event of a failure of a component within a fuel delivery system associated with the engine 12. For example as illustrated in FIGS. 1 and 5, the fuel pump 14 includes a high pressure bypass ball valve 100 disposed within a high pressure bypass chamber 102 defined by the housing 30. The high pressure bypass ball valve 100 is configured to direct fuel through the fuel pump 14 in the event of a pressure regulator failure within a fuel rail leading from the fuel pump 14 to the engine 12.

For example, taking FIGS. 1 and 5 collectively, in a fuel rail 104, a regulator valve (not shown) typically controls the flow rate of the fuel delivered to the engine 12 from the fuel pump 14 regardless of the back pressure within the fuel pump 14. If the regulator valve fails, the fuel pressure within the fuel rail 104 can increase until the fuel rail 104 bursts. In the case of failure of the regulator valve in the fuel rail 104, pressurized fuel flows within the fuel rail 104 and into the fuel pump 14 from the pump outlet 22. The fuel pressure overcomes a spring force exerted on a ball 106 of the high pressure bypass ball valve 100 by a spring 108 of the ball valve 100 and translates the ball 106 away from a stop 107. Such positioning of the ball valve 100 allows the fuel to exit the fuel pump 14 through the pump inlet 20 to decrease the pressure within the fuel rail 104. The configuration of the high pressure bypass ball valve 100 minimizes the risk of failure of the fuel rail 104 with a minimal number of operating parts. The high pressure bypass ball valve 100 therefore can be easily assembled by a manufacturer at a relatively reduced cost as compared to conventional pressure release valves found in conventional fuel pumps.

In one arrangement, the fuel pump 14 also includes low pressure bypass ball valve 110 disposed within a low pressure bypass chamber 112 defined by the housing 30. As illustrated, the low pressure bypass ball valve 110 includes a ball 114 and a spring 116. In one arrangement, the low pressure bypass ball valve 110 is configured to allow priming of the fuel pump 14 prior to operation. For example, prior to operation, the fuel pump 14 typically contains vaporized fuel contained within the pump chamber 31. To purge the vapor from the pump chamber 31, an operator activates a secondary pump (not shown) that causes fuel to flow into the inlet 20 of the fuel pump. The pressure of the fuel overcomes a spring force exerted on the ball 114 by the spring 116 to translate the ball 114 away from a stop 118 and allows the fuel to flow into the pump chamber 31 via the pump outlet 22, thereby purging the fuel pump 31 of vaporized fuel. Additionally, in the event of failure of the fuel pump 14, the low pressure bypass ball valve 110 provides a pathway for fuel to flow through the fuel pump 14 to a secondary fuel pump disposed between the fuel pump 14 and the engine 12, to allow operation of the engine 12. The configuration of the low pressure bypass ball valve 110 therefore allows priming of the fuel pump 14 and provides a fuel pathway from the fuel tank 16 to a secondary fuel pump with a minimal number of operating parts. The low pressure bypass ball valve 110 therefore can be easily assembled by a manufacturer at a relatively reduced cost as compared to conventional pressure release valves found in conventional fuel pumps.

While various embodiments of the invention have been particularly shown and described, it will be understood by those skilled in the art that various changes in form and details may be made therein without departing from the spirit and scope of the invention as defined by the appended claims.

For example, as indicated above, the first and second lip seals 54, 56 provide redundant sealing within the fuel pump 14 to minimize engine oil from entering the pump chamber 31 and to minimize fuel from entering the engine 12. In one arrangement, however, each lip seal 54, 56 includes two distinct sealing portions to provide additional redundancy of the sealing. For example, returning to FIG. 3 taking the first lip seal 54 as an example, the first lip seal 54 includes a first sealing portion 120 and a second sealing portion 122 disposed about the shaft 40 of the impeller 36 and disposed in a spaced apart relationship relative to each other. In this arrangement, the first and second sealing portions 120, 122 define a collection volume 124 with the shaft 40 for collecting either fuel or oil that leaks within the fuel pump 14.

As indicated above, the shaft 40 of the impeller 36 couples to the driving apparatus 18, such as a gear box, by a drive coupling element 48. In one arrangement, in order to limit or prevent damage to the driving apparatus 18, the drive coupling element 48 is designed to fail if the impeller assembly 32 becomes jammed during operation. For example, returning to FIG. 3, the drive element 48 includes a reduced diameter portion 130 located between a shaft attachment portion 132 and a gear attachment portion 134. As indicated in FIG. 3, the reduced diameter portion 130 has a diameter that is smaller than a diameter 138 of the shaft 40 of the impeller 36. With such a configuration, assume the impeller 36 has seized within the pump chamber 31 (i.e., the impeller assembly 32 becomes locked during operation). In this case, the driving apparatus 18 continues to rotate the drive coupling element 48 via the gear attachment portion 134. However, because the drive element 48 includes the reduced diameter portion 130, continued rotation of the gear attachment portion 134 relative to the seized impeller 36 causes the gear attachment portion 134 to fracture or shear relative to the shaft attachment portion 132 at the reduced diameter portion 130. The fracture at the reduced diameter portion 130 disconnects the impeller assembly 32 of the fuel pump 14 from the engine 12 to protect the operation and integrity of the engine 12.

What is claimed is:

1. A fuel pump, comprising:

a housing;

an impeller disposed within the housing, the impeller and the housing (i) defining a pump chamber having a pump inlet and a pump outlet and (ii) defining a housing chamber, the impeller being operable to rotate within the housing to transfer fuel from the pump inlet, through the pump chamber to the pump outlet;

a bearing element disposed within the housing chamber about a shaft of the impeller, the bearing element having a sealing face opposing the impeller and being operable to form a fuel seal with the impeller; and a first lip seal disposed within the housing chamber about the shaft of the impeller and a second lip seal disposed within the housing chamber about the shaft of the impeller, the first lip seal being disposed between the bearing element and the second lip seal, the first lip seal being operable to form a fuel seal with the shaft of the impeller and the second lip seal being operable to form an oil seal with the shaft of the impeller;

wherein the bearing element defines a channel within the sealing interface extending from an inner periphery of the bearing element to an outer periphery of the bearing element, the channel being operable to collect fuel leaked from the pump chamber and to direct the leaked fuel toward the pump inlet of the fuel pump.

2. The fuel pump of claim 1, further comprising a carrier sleeve disposed within the housing chamber of the housing, the first lip seal and the second lip seal being coupled to the carrier sleeve such that the first lip seal and the second lip seal define a fluid containment volume between the first lip seal and the second lip seal, the carrier sleeve defining a drain port in fluid communication with the fluid containment volume and in fluid communication with an outflow port of the housing.

3. The fuel pump of claim 2, wherein the carrier sleeve defines a channel disposed about an outer periphery of the carrier sleeve and wherein the carrier sleeve defines a plurality of drain ports disposed about a circumference of the carrier sleeve, the plurality of drain ports in fluid communication with the fluid containment volume defined between the first lip seal and the second lip seal and in fluid communication with the channel, at least one of the plurality of drain ports in fluid communication with the outflow port of the housing.

4. The fuel pump of claim 1, wherein at least one of the first lip seal and the second lip seal comprises a first sealing portion and a second sealing portion disposed about the shaft of the impeller, the first sealing portion and the second sealing portion disposed in a spaced apart relationship relative to each other.

5. The fuel pump of claim 1, wherein the housing defines a high pressure bypass chamber in fluid communication with the pump chamber and wherein the fuel pump comprises a high pressure bypass ball valve disposed within the high pressure bypass chamber.

6. The fuel pump of claim 1, wherein the housing defines a low pressure bypass chamber in fluid communication with the pump chamber and wherein the fuel pump comprises a low pressure bypass ball valve disposed within the low pressure bypass chamber.

7. The fuel pump of claim 1, comprising a fuel filter disposed within a pump outlet chamber defined by the pump outlet, the fuel filter in fluid communication with the pump chamber of the housing and being operable to receive a flow of fuel from the pump chamber.

8. The fuel pump of claim 1, wherein the shaft of the impeller comprises a drive element being operable to couple the impeller to an impeller driving apparatus of an engine, the drive element having a reduced diameter portion, the reduced diameter portion having a diameter that is smaller than a diameter of the shaft of the impeller.

9. An engine assembly, comprising:

an engine; and a fuel pump coupled to the engine, the fuel pump comprising:

a housing, an impeller disposed within the housing, the impeller and the housing defining a pump chamber having a pump inlet and a pump outlet and defining a housing chamber, the impeller being operable to rotate within the housing to transfer fuel from the pump inlet, through the pump chamber, and to the engine via the pump outlet, a bearing element disposed within the housing chamber about a shaft of the impeller, the bearing element having a sealing face opposing the impeller and being operable to form a fuel seal with the impeller, and a first lip seal disposed within the housing chamber about the shaft of the impeller and a second lip seal disposed within the housing chamber about the shaft of the impeller, the first lip seal disposed between the bearing element and the second lip seal, the first lip seal being operable to form a fuel seal with the shaft of the impeller and the second lip seal being operable to form an oil seal with the shaft of the impeller;

wherein the bearing element defines a channel within the sealing interface extending from an inner periphery of the bearing element to an outer periphery of the bearing element, the channel being operable to collect fuel leaked from the pump chamber and to direct the leaked fuel toward the pump inlet of the fuel pump.

10. The engine assembly of claim 9, further comprising a carrier sleeve disposed within the housing chamber of the housing, the first lip seal and the second lip seal being coupled to the carrier sleeve such that the first lip seal and the second lip seal define a fluid containment volume between the first lip seal and the second lip seal, the carrier sleeve defining a drain port in fluid communication with the fluid containment volume and in fluid communication with an outflow port of the housing.

11. The engine assembly of claim 10, wherein the carrier sleeve defines a channel disposed about an outer periphery of the carrier sleeve and wherein the carrier sleeve defines a plurality of drain ports disposed about a circumference of the carrier sleeve, the plurality of drain ports in fluid communication with the fluid containment volume defined between the first lip seal and the second lip seal and in fluid communication with the channel, at least one of the plurality of drain ports in fluid communication with the outflow port of the housing.

12. The engine assembly of claim 9, wherein at least one of the first lip seal and the second lip seal comprises a first sealing portion and a second sealing portion disposed about the shaft of the impeller, the first sealing portion and the second sealing portion disposed in a spaced apart relationship relative to each other.

13. The engine assembly of claim 9, wherein the housing defines a high pressure bypass chamber in fluid communication with the pump chamber and wherein the fuel pump comprises a high pressure bypass ball valve disposed within the high pressure bypass chamber.

14. The engine assembly of claim 9, wherein the housing defines a low pressure bypass chamber in fluid communication with the pump chamber and wherein the fuel pump comprises a low pressure bypass ball valve disposed within the low pressure bypass chamber.

15. The engine assembly of claim 9, comprising a fuel filter disposed within a pump outlet chamber defined by the pump outlet, the fuel filter in fluid communication with the pump chamber of the housing and being operable to receive a flow of fuel from the pump chamber.

16. The engine assembly of claim 9, wherein the impeller shaft comprises a drive element being operable to couple the impeller to an impeller driving apparatus of an engine, the drive element having a reduced diameter portion, the reduced diameter portion having a diameter that is smaller than a diameter of the impeller shaft.

17. A method for assembly of a fuel pump, comprising:

disposing an impeller within a housing, the impeller and the housing defining a pump chamber having a pump inlet and a pump outlet and defining a housing chamber, the impeller being operable to rotate within the housing to transfer fuel from the pump inlet, through the pump chamber to the pump outlet;

disposing a bearing element within the housing chamber about a shaft of the impeller, the bearing element having a sealing face opposing the impeller and being operable to form a fuel seal with the impeller; and disposing a first lip seal within the housing chamber about the shaft of the impeller and a second lip seal disposed within the housing chamber about the shaft of the impeller, the first lip seal disposed between the bearing element and the second lip seal, the first lip seal being operable to form a fuel seal with the shaft of the impeller and the second lip seal being operable to form an oil seal with the shaft of the impeller;

wherein the bearing element defines a channel within the sealing interface extending from an inner periphery of the bearing element to an outer periphery of the bearing element, the channel being operable to collect fuel leaked from the pump chamber and to direct the leaked fuel toward the pump inlet of the fuel pump.

18. The method of claim 17, comprising disposing a carrier sleeve within the housing chamber of the housing, the first lip seal and the second lip seal being coupled to the carrier sleeve such that the first lip seal and the second lip seal define a fluid containment volume between the first lip seal and the second lip seal, the carrier sleeve defining a drain port in fluid communication with the fluid containment volume and in fluid communication with an outflow port of the housing.

19. The method of claim 17, comprising disposing a high pressure bypass ball valve within a high pressure bypass chamber defined by the housing, the high pressure bypass ball valve in fluid communication with the pump chamber.

20. The method of claim 17, comprising disposing a low pressure bypass ball valve within a low pressure bypass chamber defined by the housing, the low pressure bypass ball valve in fluid communication with the pump chamber.

21. A fuel pump, comprising:

a housing;

an impeller disposed within the housing, the impeller and the housing (i) defining a pump chamber having a pump inlet and a pump outlet and (ii) defining a housing chamber, the impeller being operable to rotate within the housing to transfer fuel from the pump inlet, through the pump chamber to the pump outlet;

a bearing element disposed within the housing chamber about a shaft of the impeller, the bearing element having a sealing face opposing the impeller and being operable to form a fuel seal with the impeller; and a first lip seal disposed within the housing chamber about the shaft of the impeller and a second lip seal disposed within the housing chamber about the shaft of the impeller, the first lip seal being disposed between the bearing element and the second lip seal, the first lip seal being operable to form a fuel seal with the shaft of the impeller and the second lip seal being operable to form an oil seal with the shaft of the impeller;

wherein the housing defines a high pressure bypass chamber in fluid communication with the pump chamber and wherein the fuel pump comprises a high pressure bypass ball valve disposed within the high pressure bypass chamber.

22. A fuel pump, comprising:

a housing;

an impeller disposed within the housing, the impeller and the housing (i) defining a pump chamber having a pump inlet and a pump outlet and (ii) defining a housing chamber, the impeller being operable to rotate within the housing to transfer fuel from the pump inlet, through the pump chamber to the pump outlet;

a bearing element disposed within the housing chamber about a shaft of the impeller, the bearing element having a sealing face opposing the impeller and being operable to form a fuel seal with the impeller; and a first lip seal disposed within the housing chamber about the shaft of the impeller and a second lip seal disposed within the housing chamber about the shaft of the impeller, the first lip seal being disposed between the bearing element and the second lip seal, the first lip seal being operable to form a fuel seal with the shaft of the impeller and the second lip seal being operable to form an oil seal with the shaft of the impeller;

wherein the housing defines a low pressure bypass chamber in fluid communication with the pump chamber and wherein the fuel pump comprises a low pressure bypass ball valve disposed within the low pressure bypass chamber.

23. A fuel pump, comprising:

a housing;

an impeller disposed within the housing, the impeller and the housing (i) defining a pump chamber having a pump inlet and a pump outlet and (ii) defining a housing chamber, the impeller being operable to rotate within the housing to transfer fuel from the pump inlet, through the pump chamber to the pump outlet;

a bearing element disposed within the housing chamber about a shaft of the impeller, the bearing element having a sealing face opposing the impeller and being operable to form a fuel seal with the impeller; and a first lip seal disposed within the housing chamber about the shaft of the impeller and a second lip seal disposed within the housing chamber about the shaft of the impeller, the first lip seal being disposed between the bearing element and the second lip seal, the first lip seal being operable to form a fuel seal with the shaft of the impeller and the second lip seal being operable to form an oil seal with the shaft of the impeller;

wherein the shaft of the impeller comprises a drive element being operable to couple the impeller to an impeller driving apparatus of an engine, the drive element having a reduced diameter portion, the reduced diameter portion having a diameter that is smaller than a diameter of the shaft of the impeller.

* * * * *